US012139974B2

(12) United States Patent
Liu et al.

(10) Patent No.: US 12,139,974 B2
(45) Date of Patent: Nov. 12, 2024

(54) PETROLEUM DRILL-STRING SHOCK ABSORBERS

(71) Applicants: University of Science and Technology Beijing, Beijing (CN); Shunde Graduate School, University of Science and Technology Beijing, Foshan (CN)

(72) Inventors: Haiping Liu, Beijing (CN); Qi Lv, Beijing (CN); Dashan Shen, Beijing (CN); Donghang Han, Beijing (CN); Dongmei Zhu, Foshan (CN)

(73) Assignees: University of Science and Technology Beijing, Beijing (CN); Shunde Graduate School, University of Science and Technology Beijing, Foshan (CN)

( * ) Notice: Subject to any disclaimer, the term of this patent is extended or adjusted under 35 U.S.C. 154(b) by 430 days.

(21) Appl. No.: 17/700,555

(22) Filed: Mar. 22, 2022

(65) Prior Publication Data

US 2023/0304361 A1 Sep. 28, 2023

(51) Int. Cl.
*E21B 17/07* (2006.01)

(52) U.S. Cl.
CPC ..... *E21B 17/076* (2013.01)

(58) Field of Classification Search
CPC ..... E21B 17/07; E21B 17/073; E21B 17/076
See application file for complete search history.

(56) References Cited

U.S. PATENT DOCUMENTS 2,953,351 A * 9/1960 Bodine ..... E21B 7/24 175/320
3,156,106 A * 11/1964 Crane ..... E21B 17/073 175/323
3,947,008 A * 3/1976 Mullins ..... E21B 17/07 267/125
2016/0230479 A1* 8/2016 Khaparde ..... E21B 17/07

FOREIGN PATENT DOCUMENTS

CN 112593868 * 4/2021
CN 214944059 * 11/2021

* cited by examiner

*Primary Examiner* — D. Andrews

(57) ABSTRACT

A petroleum drill-string shock absorber includes a drill collar nipple, a driving unit, an outer shell, a helical guideway, a drill bit base, a woven metal ring and a vibration-absorbing composite beam, the vibration-absorbing composite beam consists of a sheet metal and a flexible material gasket bonded by an adhesive; the drill collar nipple is connected with the helical guideway; the helical guideway is connected with the drill bit base; the driving unit rotates on the helical guideway; the outer shell is connected with the drill bit base; a metal seal ring is configured to seal a space formed between the outer shell and the drill collar nipple, a sealed space is formed among the drill collar nipple, the outer shell and the drill bit base; the woven metal ring is placed between the helical guideway and the drill bit base configured to absorb an axial impact vibration.

7 Claims, 6 Drawing Sheets

PETROLEUM DRILL-STRING SHOCK ABSORBERS

TECHNICAL FIELD

The present application relates to the technical field of drilling engineering, and in particular to a petroleum drill-string shock absorber.

BACKGROUND

During the rapid development of drilling technology in the petroleum industry, the axial direction, radial direction and torsional shock vibration problems caused by the rock-breaking characteristics of the drill bit are very prominent, especially when there is a hardness change in the drilling formation. Drill-string vibration has great hazards, including: the phenomenon of jumping drill, frequent impact of the drill bit and drilling affects the life of the drill bit, unstable bit pressure reduces work efficiency, damages ground equipment, and increases drilling costs.

SUMMARY

The present application provides a petroleum drill-string shock absorber, comprising: a drill collar nipple, a driving unit, an outer shell, a helical guideway, a drill bit base, a woven metal ring and a vibration-absorbing composite beam, the vibration-absorbing composite beam is consisted of a sheet metal and a flexible material gasket bonded by an adhesive; the drill collar nipple is connected with the helical guideway; the helical guideway is connected with the drill bit base; the driving unit may rotate on the helical guideway; the outer shell is connected with the drill bit base; a metal seal ring is configured to seal the space formed between the outer shell and the drill collar nipple, a sealed space is formed among the drill collar nipple, the outer shell and the drill bit base; the woven metal ring is placed between the helical guideway and the drill bit base configured to absorb axial impact vibration; the vibration-absorbing composite beam is fixedly connected with the driving unit and the helical guideway by a screw, a phase difference is formed between the driving nipple and the helical guideway after the drill bit is subjected to torsional vibration, and furthermore, the vibration-damping of the drill bit is realized by the torsional deformation energy dissipation of the vibration-absorbing composite beam.

In some embodiments, the width of the sheet metal and the flexible material gasket are the same, the thickness and the length of the two metal sheets may be adjusted according to specific needs; the flexible material is a high-damping vibration-damping material, such as elastic rubber, which helps to reduce vibrations. The sheet metal is a metal material with high elasticity and good strength, such as stainless steel.

In some embodiments, the woven metal ring (6) is provided with multi-section ring gradient changes to achieve vibration-damping of different amplitudes in an axial direction. A pre-tightening force is applied among the woven metal ring, the helical guideway and the drill bit base, which can enhance the absorption capacity of axial vibration.

In some embodiments, when the drill bit is subjected to torsional vibration, the driving unit may move clockwise downwards to twist the vibration-absorbing composite beam, when the external load is stable, the vibration-absorbing composite beam drives the driving unit to move upwards to the initial state due to its own restoring force.

In some embodiments, the helical angle design of the helical guideway needs to comprehensively consider the parameters of the drill bit, the formation parameters, the torsional stiffness, the axial stiffness and other parameters, and it needs to be selected according to the actual situation.

In some embodiments, the vibration-absorbing composite beam is installed in a circumferential direction array, and no less than three installation positions are arranged, each installation position may be installed no less than one vibration-absorbing composite beam.

In some embodiments, the connection of the drill collar nipple, the helical guideway and the drill bit base is a thread connection, and the connection between the drill bit base and the outer shell is the thread connection, and there is a clearance fit between the outer shell and the driving unit.

In some embodiments, both an outer diameter and an inner diameter of the drill collar nipple, the outer shell and the drill bit base are the same, and the inner diameter is same as the inner diameter of the drill collar connected to the upper end, the contact position of the drill collar nipple and the outer shell is provided with a step, and the upper end outer edge of the drill bit base is provided with a step and an external thread and is threadedly connected with the outer shell.

In some embodiments, the vibration-absorbing composite beam and the driving unit are replaced with an electromagnetic eddy current retarder, and the electromagnetic eddy current retarder comprise an permanent magnet and an electric eddy current plate, the permanent magnet is fixed in the middle of the helical guideway, and there are one section of guideway at the front and back respectively, the electric eddy current plate is placed between the two permanent magnets, and a gap is arranged between the two permanent magnets to make the electric eddy current plate move, the inner diameter of the electric eddy current plate is matched with the helical groove on the helical guideway, so that the electric eddy current plate and the helical guideway move relatively.

In some embodiments, the permanent magnet is formed by an iron core and a magnet in an alternate permutation manner, and the connection between the permanent magnet and the helical guideway is the wedge key connection, realizing a localization of the permanent magnet in an axial and radial direction; the radial periodic array of the electric eddy current plate is not less than three cavities, forming a stable eddy current loop; the cross section of the electric eddy current plate is an I-shaped, which increases the area of the cutting magnetic induction line and increase the Lorentz force, thereby enhancing the vibration-damping efficiency of the electromagnetic eddy current damper.

In some embodiments, the vibration-absorbing structure consisted of the vibration-absorbing composite beam and the driving unit is replaced with a steel plate rotor friction damper consisted of multi-layer steel plates, the steel plate rotor friction damper is consisted of a multi-layer corrugated steel plate and a multi-layer smooth steel plate, there is an interference fit between the helical guideway and the multi-layer smooth steel plate, there is an interference fit between the multi-layer corrugated steel plate and the multi-layer smooth steel plates, and a limiting displacement ring is arranged at the lower part of the multi-layer smooth steel plates.

In some embodiments, the number of layers of the multi-layer corrugated steel plate (12) is from 2 to 70 layers.

In some embodiments, the application absorbs axial vibration by using a woven metal ring, compared with ordinary springs and rubber bearings, which has more stable mechanical properties, a smaller volume, and may isolate vibration and effectively reduce amplitude;

absorbing torsional vibration by using a torsional deformation of the vibration-absorbing composite beam, compared with other forms, the vibration-absorbing composite beam may provide a higher rigidity and damping, which is not easy to fatigue, and is suitable for using in drilling equipment;

having a stable vibration-damping, simple structure and convenient installation, which does not require additional energy supply, and is less affected by the bit pressure environment, and may replace traditional rubber bearings, spring vibration isolators and hydraulic vibration isolators;

selecting different parameters according to the requirements of different types of drilling equipment to suppress the vibration frequency band and amplitude, so as to realize the adjustability of the effective vibration absorption frequency band and the attenuation performance;

using a steel plate rotor friction damper, which may be easily installed in a mechanical system, which has a reliable operation, simple structure, good manufacturing technology, long working life, having high cushioning performance within a certain vibration amplitude range of the rotor, and may bear a certain static load at the same time. The damper may work well under the conditions of high temperature, radiation and corrosive media, and its cushioning performance and rigidity are very stable during the entire working life; and the multiple embodiments of the present application can be used in superposition to achieve vibration suppression in the three directions of axial, radial and torsion.

Figure 1:
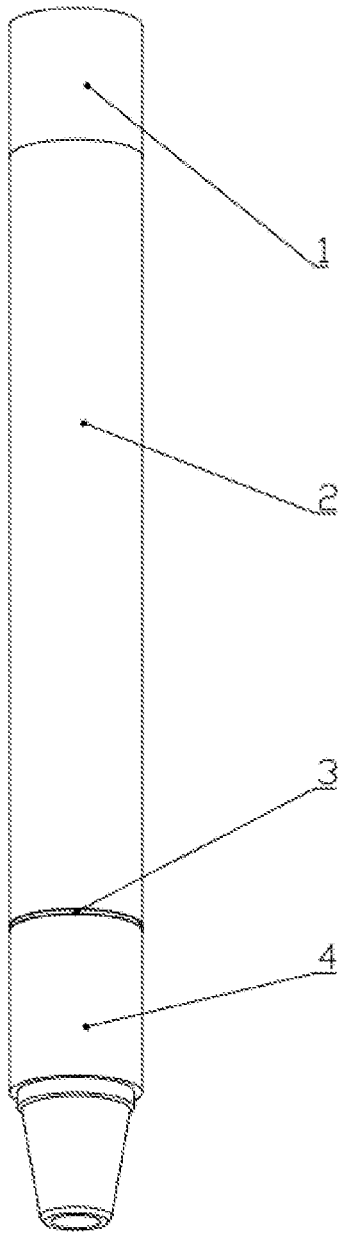
FIG. 1 is a schematic diagram of the appearance and structure of the petroleum drill-string shock absorber of the present application.
Figure 2:
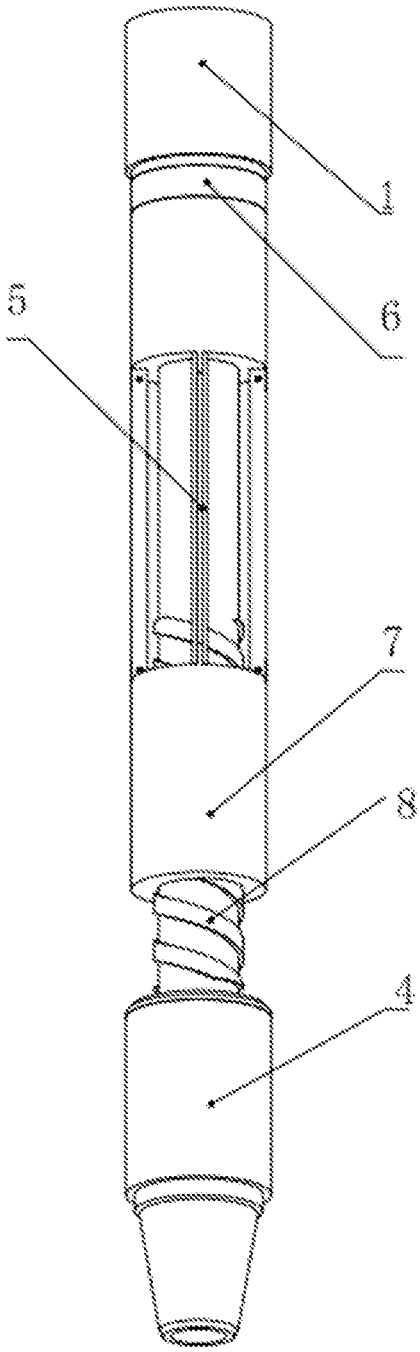
FIG. 2 is a schematic diagram of the internal structure of the petroleum drill-string shock absorber of the present application.
Figure 3:
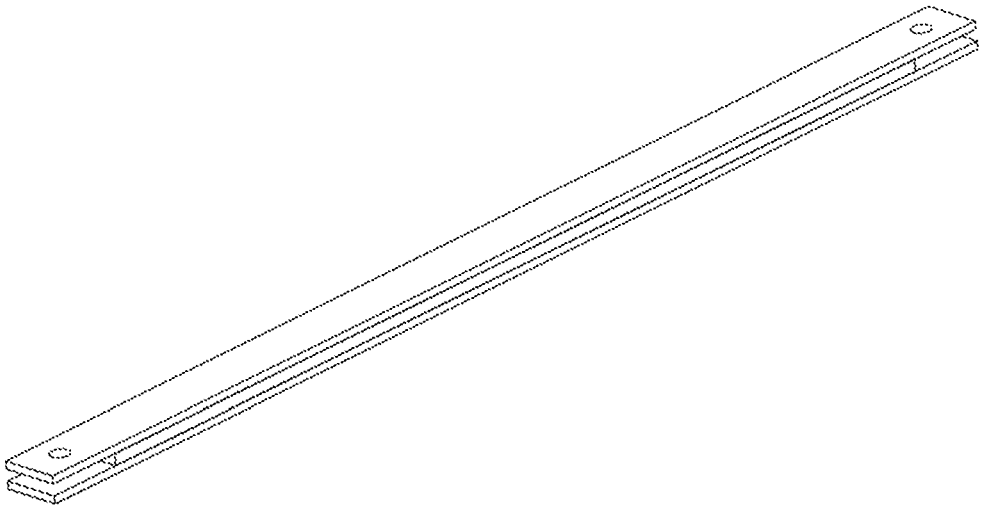
FIG. 3 is a structural schematic diagram of the vibration-absorbing composite beam of the petroleum drill-string shock absorber of the present application.
Figure 4:
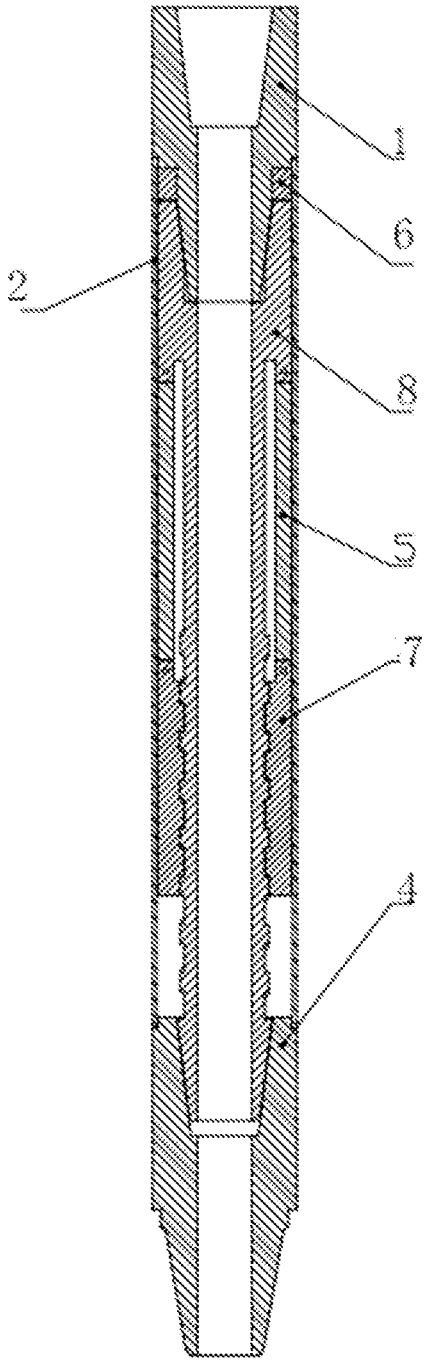
FIG. 4 is a cross-sectional view of the petroleum drill-string shock absorber of the present application.

In the figures, 1—drill bit base 2—outer shell; 3—metal seal ring; 4—drill collar nipple; 5—vibration-absorbing composite beam; 6—woven metal ring; 7—driving unit; 8—helical guideway; 9—permanent magnet; 10—electric eddy current plate; 11—multi-layer smooth steel plate; 12—multi-layer corrugated steel plate; 13—limiting displacement ring.

DETAILED DESCRIPTION OF THE EMBODIMENTS

Embodiments of the present application will be described in detail below with reference to the accompanying drawings. Apparently, the embodiments described are merely part of the embodiments of the present application rather than all the embodiments. On the basis of the embodiments in the present application, all other embodiments which those skilled in the art obtain without making creative efforts shall fall within the protection scope of the present application.

The application provides a petroleum drill-string shock absorber.

In some embodiments, as shown in FIGS. 1-4, the shock absorber comprises a drill collar nipple 4, a driving unit 7, an outer shell 2, a helical guideway 8, a drill bit base 1, a woven metal ring 6 and a vibration-absorbing composite beam 5, the vibration-absorbing composite beam 5 is consisted of a sheet metal and a flexible material gasket bonded by an adhesive; the drill collar nipple 4 is connected with the helical guideway 8; the helical guideway 8 is connected with the drill bit base 1; the driving unit 7 may rotate on the helical guideway 8; the outer shell 2 is connected with the drill bit base 1; a metal seal ring 3 is configured to seal the space formed between the outer shell 2 and the drill collar nipple 4, a sealed space is formed among the drill collar nipple 4, the outer shell 2 and the drill bit base; the woven metal ring 6 is placed between the helical guideway 8 and the drill bit base 1 configured to absorb axial impact vibration; the vibration-absorbing composite beam 5 is fixedly connected with the driving unit 7 and the helical guideway 8 by a screw.

In some embodiments, the vibration-absorbing composite beam is symmetrically installed on the helical guideway and the driving unit through bolts, and the woven metal ring is placed between the drill bit base and the helical guideway, and apply a pre-tension to the woven metal ring. When torsional vibration occurs, there is a phase difference between the driving unit and the helical guideway, and a relative movement occurs, the driving unit drives the vibration-absorbing composite beam to undergo torsional deformation and absorb the torsional vibration; and when the vibration-absorbing composite beam is deformed torsionally, a force opposite to the vibration direction will be generated, the force will act on the helical guideway and decompose the radial reaction force, driving the drill bit base to lift up, reducing the bit pressure and reducing the vibration intensity of the drill bit part; when the vibration in the torsional direction disappears, the restoring force of the vibration-absorbing composite beam drives the driving unit returns to the initial position; when axial vibration occurs, the drill bit base squeezes the woven metal ring to deform and absorb the axial vibration.

In some embodiments, the width of the sheet metal and the flexible material gasket are the same, the thickness of the two metal sheets consisted of the vibration-absorbing composite beam may be adjusted; the flexible material is a high-damping vibration-damping material, and the metal sheet is a stainless steel.

In some embodiments, the woven metal ring 6 is provided with multi-section ring gradient changes to achieve vibration-damping of different amplitudes in an axial direction;

In some embodiments, the vibration-absorbing composite beam 5 is installed in a circumferential direction array, and no less than three installation positions are arranged. In the present application, the angle between the driving nipple and the installation position on the helical guideway is 0 degree, and may be changed to other angles according to different working conditions.

The helix angle of the helical guideway may be changed to other angles according to different working conditions.

In some embodiments, the connection of the drill collar nipple 4, the helical guideway 8 and the drill bit base 1 is a thread connection, and the connection between the drill bit base 1 and the outer shell 2 is a thread connection, and there is a clearance fit between the outer shell 2 and the driving unit 7.

In some embodiments, both an outer diameter and an inner diameter of the drill collar nipple 4, the outer shell 2 and the drill bit base 1 are the same, and the inner diameter is same as the inner diameter of the drill collar connected to the upper end, the contact position of the drill collar nipple 4 and the outer shell 2 is provided with a step, and the upper end outer edge of the drill bit base 1 is provided with a step and an external thread, which is threadedly connected with the outer shell 2.

Figure 5:
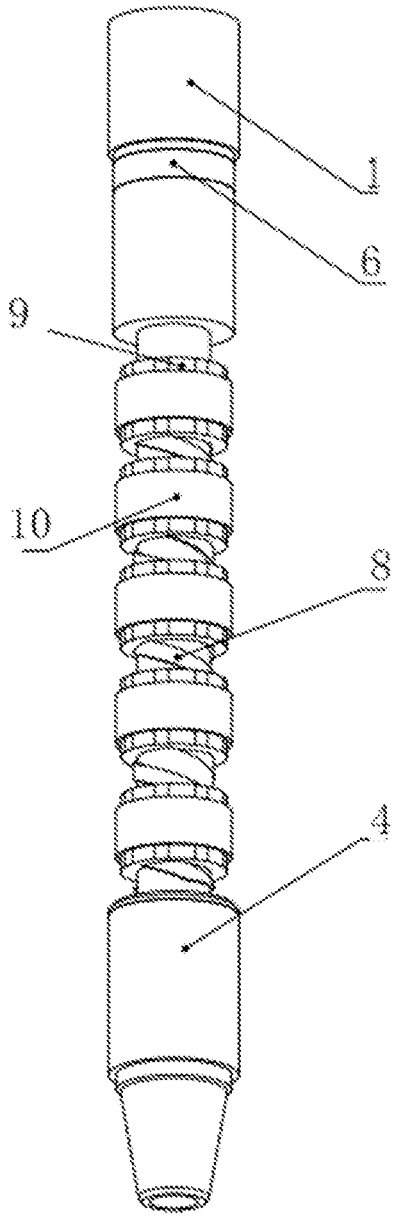
FIG. 5 is a structural diagram of an electromagnetic eddy current composite drill pipe shock absorber without an outer shell.

In some embodiments, as shown in FIG. 5, the vibration-absorbing composite beam 5 and the driving unit 7 are replaced with an electromagnetic eddy current retarder, obtaining an electromagnetic eddy current composite drill pipe shock absorber, and the electromagnetic eddy current retarder comprise an permanent magnet 9 and an electric eddy current plate 10, the permanent magnet 9 is fixed on the helical guideway 8, the electric eddy current plate 10 is placed between the two permanent magnets 9, and a gap is arranged between the two permanent magnets 9 to make the electric eddy current plate 10 move, the inner diameter of the electric eddy current plate 10 is matched with the helical groove on the helical guideway 8, so that the electric eddy current plate (10) and the helical guideway (8) move relatively.

In some embodiments, the shock-absorbing principle of the electromagnetic eddy current composite drill pipe shock absorber is as follows: when subjected to axial vibration, the vibration is deformed by the drill bit base squeezing the metal ring to absorb the axial vibration, which is same as the shock-absorbing method of the multi-form composite drill pipe damper. When torsional vibration occurs, a phase difference is generated between the electric eddy current plate and the helical guideway, and the electric eddy current plate cuts the magnetic line of induction to generate a braking force opposite to the direction of movement to absorb axial vibration. When Lorentz force acts on the helical groove of the helical guideway, the upward force in the axial can be resolved, and the drill bit may be lifted up to reduce the vibration intensity.

In some embodiments, the permanent magnet 9 is formed by an iron core and a magnet in an alternate permutation manner, which can increase the magnetic induction line density of cutting; the connection between the permanent magnet 9 and the helical guideway 8 is a wedge key connection, realizing a localization of the permanent magnet 9 in an axial and radial direction; the radial periodic array of the electric eddy current plate 10 is not less than three cavities, forming a stable eddy current loop, so that the Lorentz force generated during the radial cutting of the magnetic line of induction by the electric eddy current plate is greater; the cross section of the electric eddy current plate 10 is an I-shaped, it may cut the magnetic lines of induction outside the surface, increasing the area of cutting the magnetic lines of induction.

In some embodiments, the permanent magnet and the helical guideway are connected by a wedge key, which can realize the axial and radial localization of the permanent magnet. If arranging multiple sets of electromagnetic eddy current dampers, requiring pre-process the position of the helical groove on the helical guideway, and design the permanent magnet as an open-close type for easy installation.

Figure 6:
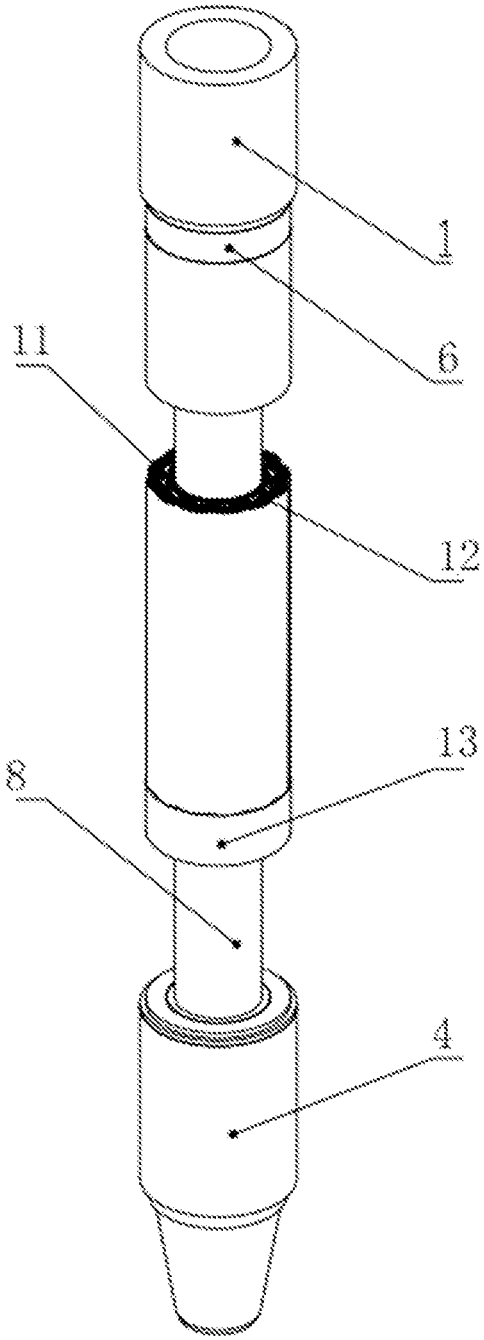
FIG. 6 is a structural diagram of a steel plate rotor friction damping drill pipe shock absorber without an outer shell.

In some embodiments, as shown in FIG. 6, the vibration-absorbing structure consisted of the vibration-absorbing composite beam 5 and the driving unit 7 is replaced with a steel plate rotor friction damper consisted of multi-layer steel plates, obtaining a steel plate rotor friction damping drill pipe shock absorber, which is consisted of a multi-layer corrugated steel plate 12 and a multi-layer smooth steel plate 11, there is an interference fit between the helical guideway 8 and the multi-layer smooth steel plate 11, there is an interference fit between the multi-layer corrugated steel plate 12 and the multi-layer smooth steel plates 11, and a limiting displacement ring 13 is arranged at the lower part of the multi-layer smooth steel plates 11. When subjected to torsional vibration, the helical guideway drives the smooth steel plate to move in the radial direction, squeezing the corrugated steel plate. The corrugated steel plate generates deformation, which absorbs axial vibration and provides restoring force, thereby reducing the radial displacement of the helical guideway. When axial vibration occurs, the speed of the helical guideway will change and further cause relative displacement, due to an interference fit between the steel plates, elastic deformation occurs, a relative displacement occurs between the steel plates, and generates friction in the circumferential direction, the friction does work to absorb the torsion vibration; when the torsional vibration disappears, the steel plate returns to the original position due to the restoring force of the corrugated steel plate.

In some embodiments, the number of layers of the multi-layer corrugated steel plate 12 is from 2 to 70 layers.

The above-mentioned multiple solutions can be superimposed and used according to the specific conditions to achieve multi-dimensional vibration attenuation in the axial, radial and torsional directions.

The description will be given below in conjunction with embodiments.

In some embodiments, the center of the upper end of the drill bit base of the application is a round table and is provided with an external thread, which may be connected with the lower end of the helical guideway, the upper end outer edge is provided with a step and an external thread, which may be connected with the outer shell, the lower end is provided with an external thread, which may be connected with the drill bit. The drill collar nipple is connected with the upper end of the helical guideway in the form of screw connection. The upper part of the drill collar nipple is provided with an external thread structure, which may be connected with the drill collar nipple. One end of the outer shell is provided with an inner thread, which is connected with the outer thread on the outer edge of the upper end of the drill seat. The other end is in contact with the lower end of the drill collar nipple, and a sealing ring is added in the middle for sealing. There is a clearance fit between the outer shell and the driving unit, which avoids contact friction between the surfaces, which prevents the movement of the driving unit from being hindered to reduce the torsional deformation of the vibration-absorbing composite beam connected to it, thereby reducing the torsional vibration absorbing effect.

In some embodiments, the connection sequence is as follows: First, the sheet metal and the flexible structural gasket are bonded to form a vibration-absorbing composite beam, and connected to the helical guideway by connecting bolts, then the driving unit is matched with the helical guide groove of the helical guideway and placed in a suitable position, and then fasten the vibration-absorbing composite beam to the driving unit through connecting bolts. The woven metal ring is placed between the drill bit base and the helical guideway, the drill bit base is connected to the helical guideway through threads, and the woven metal ring is pre-pressed. The outer shell is threadedly connected to the outer edge of the upper end of the drill bit base, and then the drill collar nipple is threaded to the upper end of the helical guideway, and the outer shell is sealed with the upper end of the outer shell by a sealing ring.

In some embodiments, the helical guideway, drill collar nipple and the center of the drill bit base are hollow cylindrical, which can be used for fluid flow. And the diameter of the central hollow cylinder is consistent with the inner diameter of the drill collar connected above, so that the internal hydraulic pressure is consistent.

In the above solution, when the drill pressure on the position of drill bit changes, generating a displacement between the drill bit base and the helical guideway, changing the amount of compression of the woven metal ring, and the vibration is absorbed through the elastic deformation of the woven metal ring. When the torque of the drill bit position changes, the driving unit and the driving guideway will form a speed difference, the driving unit will rotate around the helical guideway, and the phase difference is generated between the driving unit and the helical guideway in the circumferential direction, which drives the vibration-absorbing composite beam to twist and bend and absorb the twist vibration. The metal sheet in the vibration-absorbing composite beam provides high rigidity, and the flexible material gasket provides high damping, which may obtain high-rigidity and high-damping vibration-damping effects.

In some embodiments, the electromagnetic eddy current damping drill pipe vibration isolator, the permanent magnet is installed on the helical guideway and connected by a wedge key, the electric eddy current plate is placed between the two permanent magnets, and a gap is set in the middle to allow the electric eddy current plate to move, the inner diameter of the electric eddy current plate is matched with the helical groove on the helical guideway, so that the electric eddy current plate may move relative to the helical guideway within a certain range.

In some embodiments, the vibration attenuation principle of the electromagnetic eddy current composite drill pipe shock absorber is as follows: when subjected to axial vibration, the drill bit base squeezes the woven metal ring to generate deformation to absorb the axial vibration, which is same as the vibration attenuation method of the multi-form composite drill pipe shock absorber. When torsional vibration occurs, a phase difference is generated between the electric eddy current plate and the helical guideway, and the electric eddy current plate cuts the magnetic line of induction to generate a braking force opposite to the direction of movement to absorb axial vibration. When Lorentz force acts on the helical groove of the helical guideway, the upward force in the axial can be resolved, and the drill bit may be lifted up to reduce the vibration intensity.

In some embodiments, the steel plate rotor friction damping drill pipe shock absorber solution, the steel plate rotor friction damper is consisted of multi-layer corrugated steel plates and multi-layer smooth steel plates. Pressure is applied among each layer of steel plate, the number of layers of multi-layer corrugated steel plate is generally from 2 to 70 layers, which can be determined according to specific working conditions. The helical guideway and the multi-layer smooth steel plate have an interference fit, and the corrugated steel plate and the smooth steel plate have an interference fit. When subjected to torsional vibration, the helical guideway drives the smooth steel plate to move in the radial direction, squeezing the corrugated steel plate. The corrugated steel plate deforms, absorbing axial vibration and providing a restoring force, thereby reducing the radial displacement of the helical guideway. When the axial vibration occurs, the speed of the helical guideway will change and produce relative displacement, because of the interference fit between the steel plates, elastic deformation occurs, the relative displacement between the steel plates occurs and the friction force in the circumferential direction is generated, the friction force does work to absorb the torsion vibration; when the torsional vibration disappears, the steel plate returns to the original position due to the restoring force of the corrugated steel plate.

What is described above is merely the specific embodiments of the present application. However, the protection scope of the present application is not limited this, and any alteration or replacement which those skilled in the art can easily think of within the technical scope disclosed by the present application shall fall within the protection scope of the present application. Therefore, the protection scope of the present disclosure shall be subject to the protection scope of the claims.

What is claimed is:

1. A petroleum drill-string shock absorber, comprising:

a drill collar nipple, a driving unit, an outer shell, a helical guideway, a drill bit base, a woven metal ring, and a vibration-absorbing composite beam, wherein the vibration-absorbing composite beam consists of a sheet metal and a flexible material gasket bonded by an adhesive;

the drill collar nipple is connected with the helical guideway;

the helical guideway is connected with the drill bit base;

the driving unit rotates on the helical guideway;

the outer shell is connected with the drill bit base;

a metal seal ring is configured to seal a space formed between the outer shell and the drill collar nipple, a sealed space is formed among the drill collar nipple, the outer shell and the drill bit base;

the woven metal ring is placed between the helical guideway and the drill bit base configured to absorb an axial impact vibration;

the vibration-absorbing composite beam is fixedly connected with the driving unit and the helical guideway by a screw;

the woven metal ring is provided with multi-section ring gradient changes to achieve a vibration-damping of different amplitudes in an axial direction;

the vibration-absorbing composite beam is installed in a circumferential direction array, and at least three installation positions are arranged, at least one vibration-absorbing composite beam is installed in each of at least three installation positions, wherein the vibration-absorbing composite beams are installed in parallel; and both an outer diameter and an inner diameter of the drill collar nipple, the outer shell and the drill bit base are identical, a contact position of the drill collar nipple and the outer shell is provided with a first step, and an upper end outer edge of the drill bit base is provided with a second step and an external thread, wherein the external thread is threadedly connected with the outer shell.

2. The petroleum drill-string shock absorber according to claim 1, wherein a width of the sheet metal and the flexible material gasket are identical; and the flexible material gasket is a vibration-damping material, and the sheet metal is a stainless steel.

3. The petroleum drill-string shock absorber according to claim 1, wherein, a connection of the drill collar nipple, the helical guideway and the drill bit base is a thread connection, and the connection between the drill bit base and the outer shell is the thread connection, and there is a clearance fit between the outer shell and the driving unit.

4. A petroleum drill-string shock absorber, comprising:

a drill collar nipple, an electromagnetic eddy current retarder, an outer shell, a helical guideway, a drill bit base and a woven metal ring;

wherein the drill collar nipple is connected with the helical guideway;

the helical guideway is connected with the drill bit base;

the outer shell is connected with the drill bit base;

a metal seal ring is configured to seal a space formed between the outer shell and the drill collar nipple, a sealed space is formed among the drill collar nipple, the outer shell and the drill bit base;

the woven metal ring is placed between the helical guideway and the drill bit base configured to absorb an axial impact vibration;

the woven metal ring is provided with multi-section ring gradient changes to achieve a vibration-damping of different amplitudes in an axial direction;

both an outer diameter and an inner diameter of the drill collar nipple, the outer shell and the drill bit base are identical, a contact position of the drill collar nipple and the outer shell is provided with a first step, and an upper end outer edge of the drill bit base is provided with a second step and an external thread, wherein the external thread is threadedly connected with the outer shell;

the electromagnetic eddy current retarder comprise an permanent magnet and an electric eddy current plate, the permanent magnet is fixed on the helical guideway, the electric eddy current plate is placed between two permanent magnets, and a gap is arranged between the two permanent magnets to make the electric eddy current plate move, an inner diameter of the electric eddy current plate is matched with a helical groove on the helical guideway, wherein the electric eddy current plate and the helical guideway move relatively.

5. The petroleum drill-string shock absorber according to claim 4, wherein, the permanent magnet is formed by an iron core and a magnet in an alternate permutation manner, and a connection between the permanent magnet and the helical guideway is a wedge key connection, realizing a position of the permanent magnet in the axial direction and a radial direction; a radial direction periodic array of the electric eddy current plate has at least three cavities to form a stable eddy current loop; a cross section of the electric eddy current plate is I-shaped.

6. A petroleum drill-string shock absorber, comprising:

a drill collar nipple, a steel plate rotor friction damper consisting of a multi-layer steel plate, an outer shell, a helical guideway, a drill bit base and a woven metal ring;

wherein the drill collar nipple is connected with the helical guideway;

the helical guideway is connected with the drill bit base;

the outer shell is connected with the drill bit base;

a metal seal ring is configured to seal a space formed between the outer shell and the drill collar nipple, a sealed space is formed among the drill collar nipple, the outer shell and the drill bit base;

the woven metal ring is placed between the helical guideway and the drill bit base configured to absorb an axial impact vibration;

the woven metal ring is provided with multi-section ring gradient changes to achieve a vibration-damping of different amplitudes in an axial direction;

both an outer diameter and an inner diameter of the drill collar nipple, the outer shell and the drill bit base are identical, a contact position of the drill collar nipple and the outer shell is provided with a first step, and an upper end outer edge of the drill bit base is provided with a second step and an external thread, wherein the external thread is threadedly connected with the outer shell;

the steel plate rotor friction damper consists of a multi-layer corrugated steel plate and a multi-layer smooth steel plate, there is a first interference fit between the helical guideway and the multi-layer smooth steel plate, there is a second interference fit between the multi-layer corrugated steel plate and the multi-layer smooth steel plate, and a limiting displacement ring is arranged at a lower part of the multi-layer smooth steel plate.

7. The petroleum drill-string shock absorber according to claim 6, wherein, a number of layers of the multi-layer corrugated steel plate is from 2 to 70 layers.

* * * * *